US007513012B2

(12) United States Patent
Chao

(10) Patent No.: US 7,513,012 B2
(45) Date of Patent: Apr. 7, 2009

(54) SPLIT BARREL STRUCTURE OF HINGE

(75) Inventor: Po-Tsun Chao, Taipei (TW)

(73) Assignee: Mitac Technology Corp., Hsinchu (TW)

( * ) Notice: Subject to any disclaimer, the term of this patent is extended or adjusted under 35 U.S.C. 154(b) by 0 days.

(21) Appl. No.: 11/878,180

(22) Filed: Jul. 23, 2007

(65) Prior Publication Data

US 2008/0184530 A1 Aug. 7, 2008

(30) Foreign Application Priority Data

Feb. 6, 2007 (TW) ..... 96104233 A

(51) Int. Cl.
*E05C 17/64* (2006.01)

(52) U.S. Cl. ..... 16/342

(58) Field of Classification Search ..... 16/342, 16/254, 260, 387, 388, 381, 267, 337, 319, 16/252, 262, 266, 270, 372; 359/854
See application file for complete search history.

(56) References Cited

U.S. PATENT DOCUMENTS 2,507,759 A * 5/1950 Dath ..... 16/372
2,533,590 A * 12/1950 Kutik, Jr. ..... 281/29
3,035,864 A * 5/1962 Davidson ..... 296/97.12
4,617,699 A * 10/1986 Nakamura ..... 16/262
4,788,748 A * 12/1988 Bizek ..... 16/308
4,930,753 A * 6/1990 Alvyn ..... 256/26
5,052,078 A * 10/1991 Hosoi ..... 16/297
5,943,738 A * 8/1999 Karfiol ..... 16/342
5,967,587 A * 10/1999 Collet et al. ..... 296/97.11
6,120,084 A * 9/2000 Wieczorek ..... 296/97.1
6,176,539 B1 * 1/2001 Westerman ..... 296/97.6
6,249,951 B1 * 6/2001 Saida et al. ..... 29/434
6,296,293 B1 * 10/2001 Peterson et al. ..... 296/97.11
6,711,782 B1 * 3/2004 Su ..... 16/342
6,748,625 B2 * 6/2004 Lu ..... 16/285
6,986,188 B2 * 1/2006 Lu et al. ..... 16/330

* cited by examiner

*Primary Examiner*—Victor Batson
*Assistant Examiner*—Matthew Sullivan
(74) *Attorney, Agent, or Firm*—Quintero Law Office

(57) ABSTRACT

A split barrel structure of a hinge includes a first partial barrel and an adjoining first complementary curved part extended from a first leaf portion in a first circular direction, and a second partial barrel and an adjoining second complementary curved part extended from a second leaf portion in a second circular direction. When the first leaf portion is aligned with the second leaf portion face to face, the first partial barrel and the first complementary curved part mate with the second complementary curved part and the second partial barrel, respectively, to form a split barrel for clamping a shaft of a pintle of the hinge therein. The aligned first and second leaf portions are then bound together using binding elements. Alternatively, the first and the second leaf portion are integrally connected at an edge via a bending section.

5 Claims, 7 Drawing Sheets

SPLIT BARREL STRUCTURE OF HINGE

FIELD OF THE INVENTION

The present invention relates to a hinge, and more particularly to a split barrel structure of a hinge. The split barrel structure has two partial barrels separately extended from two mating leaf portions. When the two leaf portions are aligned with and connected to each other, defining a hollow space for retaining a shaft of a pintle.

BACKGROUND OF THE INVENTION

Hinges are quite often used in various electric and electronic apparatus to connect two members of the apparatus, so that the two members are pivotally turnable about the hinges relative to one another. For example, a notebook computer uses hinges to pivotally connect a liquid crystal display (LCD) to a computer case, so that a user may pivotally lift and close the LCD from and onto the computer case. There are still many other devices, such as mobile phones, personal digital assistants (PDAs), global positioning systems (GPSs), and many testing instruments, that use hinges thereon.

A conventional hinge mainly includes one or two leaves, each of which is formed at one lateral edge with a barrel, through which a pintle is extended. When the pintle is turned, an outer wall surface of the pintle is in frictional contact with an inner wall surface of the barrels, so as to provide a fixed moment of force required by the apparatus using the hinge. To enable the device using the hinge to always have constant friction moment when being lifted or closed, a forward-extending barrel and a reversely-extending barrel are normally provided at one lateral edge of the leaf, so that the two barrels enclose the pintle in two opposite directions.

There are various types of hinges of prior art developed to meet different demands for hinges. For example, U.S. Pat. No. 6,671,929 discloses a hinge for a notebook computer composed of a pintle, a resilient sleeve, and two barrels. Each of the two barrels is formed at one side of a leaf, and the pintle is extended through the two barrels to thereby connect to the two leaves. U.S. Pat. No. 6,820,307 discloses an elastic hinge for a notebook computer compose of a pintle and two barrels. Each of the two barrels is formed at one side of a leaf, and the pintle is extended through the two barrels to thereby connect to the two leaves. U.S. Pat. No. 6,470,532 discloses a hinge for notebook computer including a band portion having a cylinder portion formed at one edge thereof, a lid portion having an opening formed thereon, and a hinge pin extended through the cylinder portion on the band portion and the opening on the lid portion. U.S. Pat. No. 6,711,782 discloses a duplex opposite friction hinge. U.S. Pat. No. 6,321,416 discloses a hinge for a notebook computer composed of a leaf having a C-shaped sleeve formed at an edge thereof and a pintle pivotally received in the C-shaped sleeve of the leaf.

There are some problems existed in the hinges of prior art. For example, most of the conventional hinge structures include at least one leaf, one side of which is curved approximately by 360 degrees to form at least one barrel. It requires highly accurate technique and accordingly, highly precision machines to mechanically form the barrel. Once the barrel is formed, it is impossible to adjust a compression force applied by the barrel against the pintle. When the hinge has been used over a long time, the compression force applied by the barrel against the pintle would become reduced due to wearing off of material under frequent frictional contact of the barrel with the pintle.

There is also problem in the association of the pintle with the barrel. Since the formed barrel has a considerably high mechanical deformation resistance, the pintle is conventionally fitted in the barrel by aligning the pintle with the barrel and then driving the pintle into the barrel with a suitable tool. By doing this, a lot of time and labors are required while there is a high defect rate of the final products. In case of any minor error in the assembling operation, both the pintle and the leaf are subjected to damage, and the inaccurately assembled hinge has to be wasted.

SUMMARY OF THE INVENTION

A primary object of the present invention is to provide a hinge formed from two mating leaf portions which are complementarily paired to form a barrel structure for clamping a pintle therein. The split barrel structure includes two partial barrels mated with a complementary curved part each, and can therefore be more easily fabricated without the need of highly accurate mechanical forming technique.

Another object of the present invention is to provide a split barrel structure for hinge, which may include partial barrels correspondingly formed on two mating leaf portions of a hinge, so that the split barrel structure not only has good mechanical deformation resistance, but also allows easy assembling of a pintle thereto.

A further object of the present invention is to provide a split hinge barrel structure that includes two partial barrels extended from two mating leaf portions, and a pintle can be easily clamped in the partial barrels when the two mating leaf portions are aligned and bound together.

A still further object of the present invention is to provide a hinge structure that includes parts that could be separately manufactured and then easily assembled, enabling the hinge to be produced at high yield rate.

To fulfill the above objects, the present invention provides a split barrel structure for a hinge. The split barrel structure includes a first partial barrel and an adjoining first complementary curved part extended from a first leaf portion in a first circular direction, and a second partial barrel and an adjoining second complementary curved part extended from a second leaf portion in a second circular direction. When the first leaf portion is aligned with the second leaf portion face to face, the first partial barrel and the first complementary curved part mate with the second complementary curved part and the second partial barrel, respectively, to form a split barrel for clamping a shaft of a pintle of the hinge therein. The aligned first and second leaf portions are then bound together using binding elements. Alternatively, the first and the second leaf portion are integrally connected at an edge via a bending section.

Since the present invention provides a split hinge barrel structure formed from two mating parts that could be separately manufactured, a hinge can be more easily formed at high yield rate simply by assembling these mating parts together. Moreover, the split hinge barrel structure may be differently designed to meet the requirements in different usages. And, since the pintle of the hinge could be easily clamped in the split barrel structure, it is not necessary to drive the pintle into the hinge barrel with a tool, and the hinge could be assembled at high efficiency with high yield rate. In the event any one of the two mating parts of the split hinge barrel structure is inaccurately manufactured or incorrectly assembled to cause damage thereof, a user needs only to replace the damaged mating part with a good one, and it is not necessary to discard the whole hinge.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
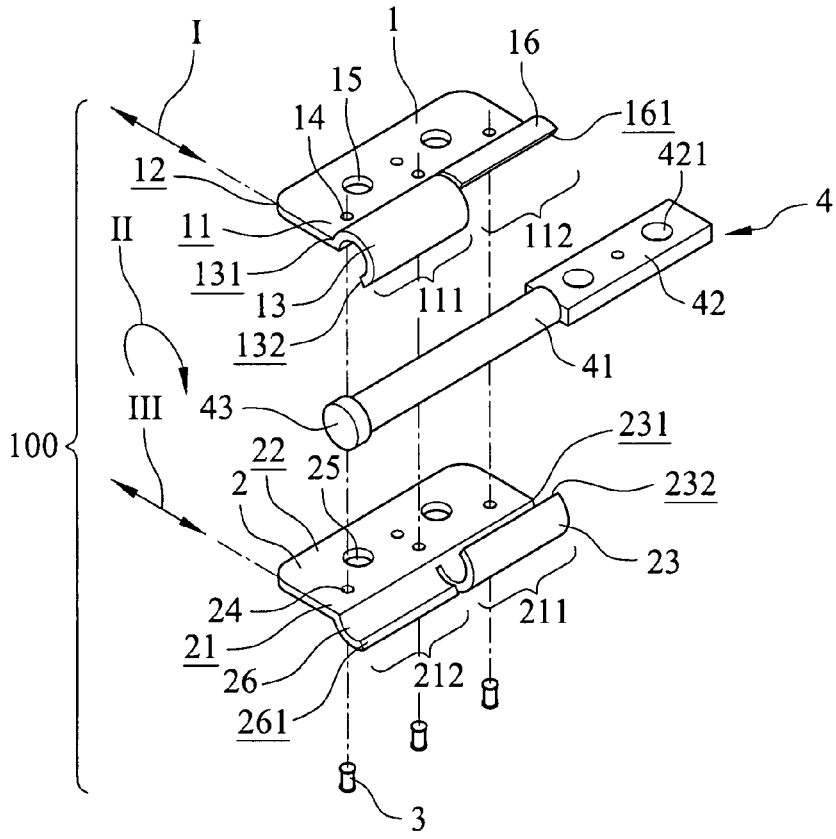
FIG. 1 is an exploded perspective view of a hinge constructed according to a first embodiment of the present invention.
Figure 2:
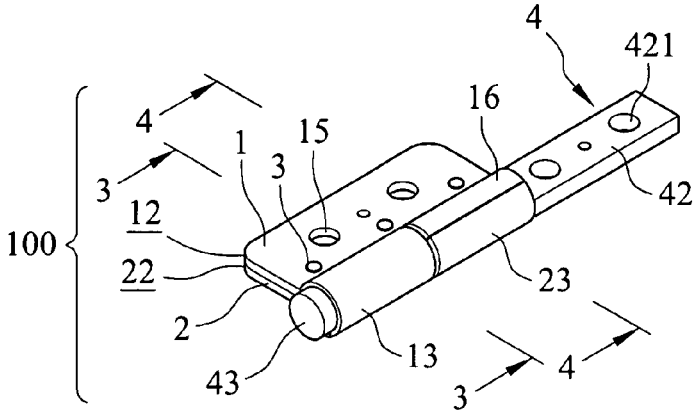
FIG. 2 is an assembled view of the hinge of FIG. 1.

Please refer to FIGS. 1 and 2 that are exploded and assembled perspective views, respectively, of a hinge 100 with a split barrel structure according to a first embodiment of the present invention. As shown, the hinge 100 includes two mating leaf portions, namely, a first leaf portion 1 and a second leaf portion 2. The first leaf portion 1 is a flat sheet member extended in a first leaf horizontal datum plane I, and has a first edge 11 and a second edge 12 opposite to the first edge 11. The first edge 11 is divided into two adjoining sections, namely, a barrel-forming section 111 and a complement-forming section 112.

Figure 3:
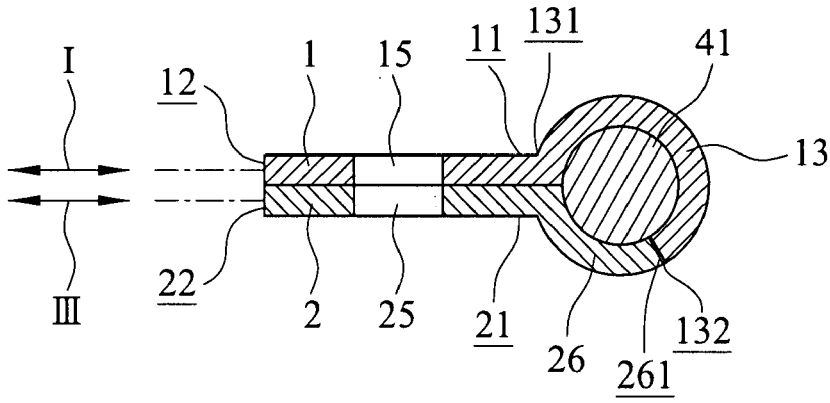
FIG. 3 is a cross sectional view taken on line 3-3 of FIG. 2.

Please also refer to FIG. 3, which is a cross sectional view taken on line 3-3 of FIG. 2. A first partial barrel 13 having a root end 131 and a free end 132 is connected at the root end 131 to the barrel-forming section 111 of the first leaf portion 1. The free end 132 of the first partial barrel 13 is extended from the root end 131 in a circular direction II toward the barrel-forming section 111 of the first leaf portion 1 to end at a point located between the first leaf horizontal datum plane I and the first edge 11 of the first leaf portion 1. As can be understood by a person skilled in the art, the free end 132 of the first partial barrel 13 may be otherwise extended longer to end at a point near the barrel-forming section 111 at the first edge 11. However, there is always a predetermined space kept between the free end 132 of the first partial barrel 13 and the first edge 11 of the first leaf portion 1.

A first complementary curved part 16 having a free end 161 is extended from the complement-forming section 112 of the first leaf portion 1 in the same circular direction II as the first partial barrel 13.

The second leaf portion 2 is a flat sheet member extended in a second leaf horizontal datum plane III, and has a first edge 21 and a second edge 22 opposite to the first edge 21. The first edge 21 is divided into two adjoining sections, namely, a barrel-forming section 211 and a complement-forming section 212. The barrel-forming section 211 of the second leaf portion 2 is located corresponding to the complement-forming section 112 of the first leaf portion 1, and the second complement-forming section 212 of the second leaf portion 2 is located corresponding to the barrel-forming section 111 of the first leaf portion 1.

Figure 4:
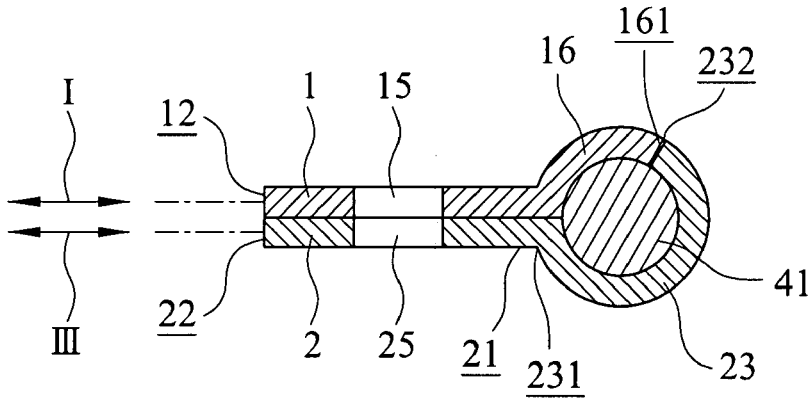
FIG. 4 is a cross sectional view taken on line 4-4 of FIG. 2.

Please also refer to FIG. 4, which is a cross sectional view taken on line 4-4 of FIG. 2. A second partial barrel 23 having a root end 231 and a free end 232 is connected at the root end 231 to the barrel-forming section 211 of the second leaf portion 2. The free end 232 of the second partial barrel 23 is extended from the root end 231 in a circular direction opposite to the circular direction II toward the barrel-forming section 211 of the second leaf portion 2 to end at a point located between the second leaf horizontal datum plane III and the first edge 21 of the second leaf portion 2. As can be understood by a person skilled in the art, the free end 232 of the second partial barrel 23 may be otherwise extended longer to end at a point near the first edge 21 of the second leaf portion 2. However, there is always a predetermined space kept between the free end 232 of the second partial barrel 23 and the first edge 21 of the second leaf portion 2.

A second complementary curved part 26 having a free end 261 is extended from the complement-forming section 212 of the second leaf portion 2 in a circular direction opposite to the circular direction II.

The first and the second leaf portion 1, 2 are correspondingly provided with at least one through hole 14, 24 each. A binding element 3 may be aligned with and then sequentially extended through the through hole 14 on the first leaf portion 1 and the through hole 24 on the second leaf portion 2 to thereby align and fasten the first leaf portion 1 with the second leaf portion 2 to form a complete leaf structure. The binding element 3 may be, for example, a bolt, a rivet, or other functionally equivalent devices, so long as it is able to fix and hold the first and the second leaf portions 1, 2 in place.

To assemble the hinge 100, firstly the first leaf portion 1 is aligned with the second leaf portion 2 face to face. At this point, the free end 161 of the first complementary curved part 16 is located adjacent to the free end 232 of the second partial barrel 23. Similarly, the free end 261 of the second complementary curved part 26 is located adjacent to the free end 132 of the first partial barrel 13. As a result, the first partial barrel 13 and the first complementary curved part 16 are mated with the second complementary curved part 26 and the second partial barrel 23, respectively, to form a split barrel structure with a hollow space therebetween for receiving a shaft 41 of a pintle 4 therein. Finally, the at least one binding element 3 is used to firmly bind the first and the second leaf portions 1, 2 together, so that the shaft 41 of the pintle 4 is compressively clamped in the split barrel structure to complete the hinge 100.

The first and the second leaf portions 1, 2 are also correspondingly provided with a plurality of fastening holes 15, 25 each. A known type of fastening elements (not shown) may be extended through the fastening holes 15, 25 to lock the first and second leaf portions 1, 2 to a desired member, such as a computer case of a notebook computer. The pintle 4 also includes an end plate 42 connected to an end of the shaft 41. The end plate 42 is provided with a plurality of fastening holes 421, via which a known type of fastening elements (not shown) may be extended to lock the end plate 42 of the pintle 4 to a desired member, such as a liquid crystal display (LCD) of a notebook computer.

Figure 5:
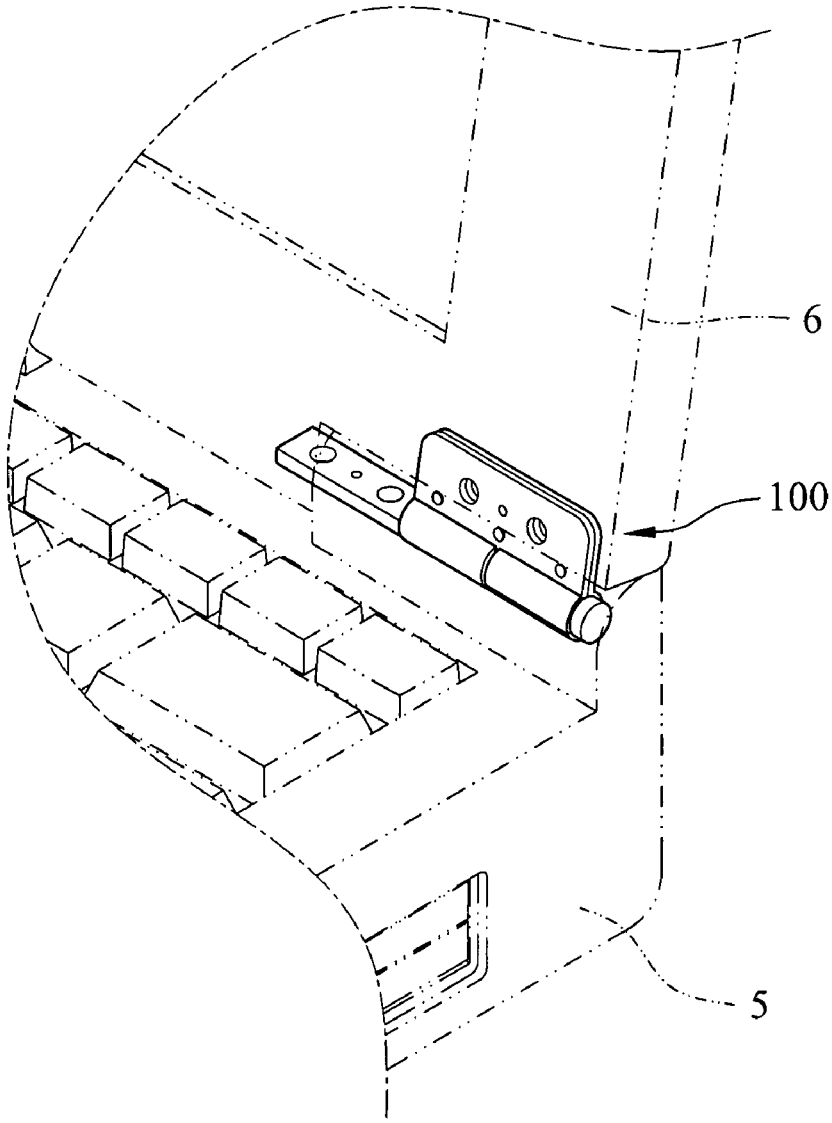
FIG. 5 shows the mounting of the hinge with the split barrel structure of FIG. 1 between a LCD and a computer case of a notebook computer.

FIG. 5 shows the mounting of the hinge 100 to a notebook computer. As shown, the hinge 100 is mounted to a position located between a computer case 5 and an LCD 6 of a notebook computer. In this manner, the LCD 6 may be lifted from or closed onto the computer case 5 via the hinge 100.

Preferably, the shaft 41 is formed at a free end opposite to the end plate 42 with an expanded head portion 43, so that the split barrel structure composed of the aligned and joined first and second partial barrels 13, 23 is located between the end plate 42 and the expanded head portion 43 when compressively receiving the shaft 41 therein. In this manner, the pintle 4 is prevented from axially separating from the split barrel structure of the hinge 100.

Figure 6:
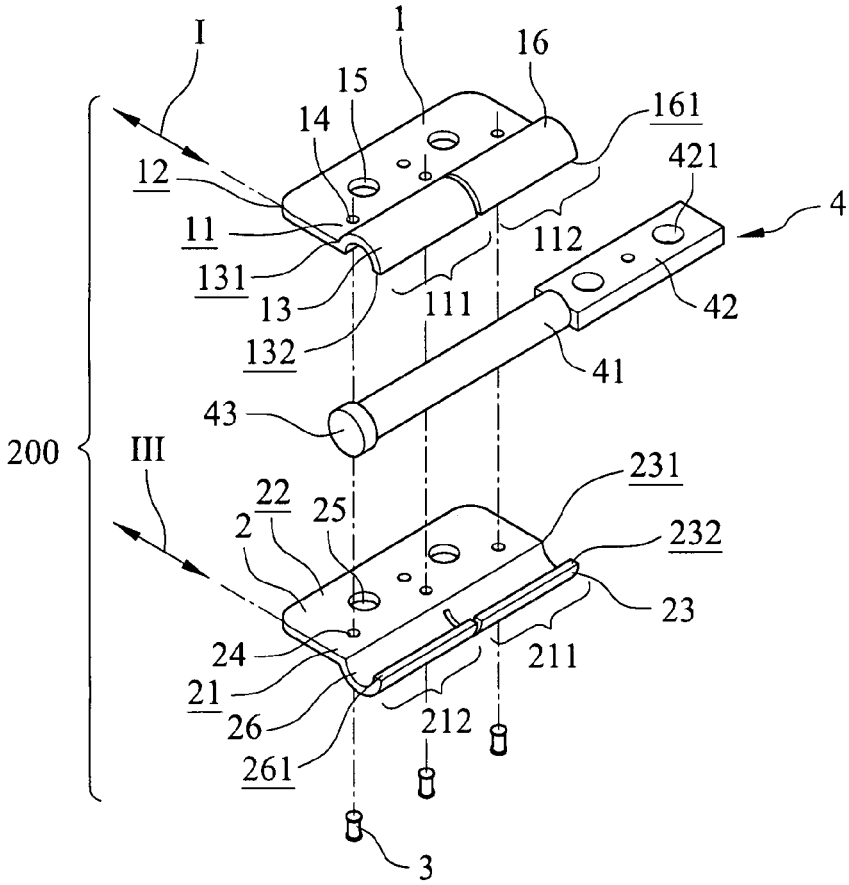
FIG. 6 is an exploded perspective view of a hinge constructed according to a second embodiment of the present invention.
Figure 7:
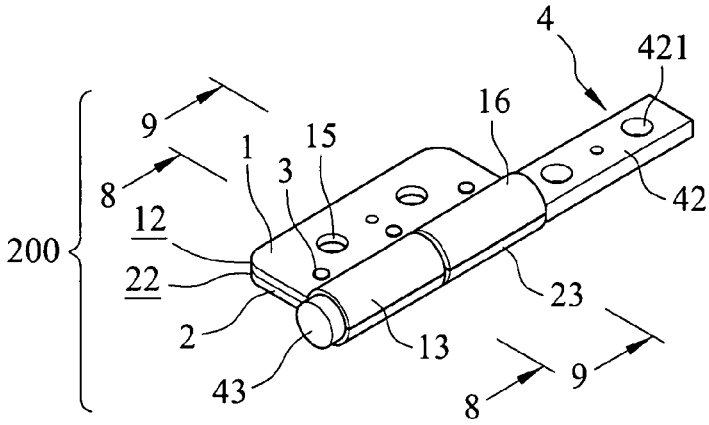
FIG. 7 is an assembled view of the hinge of FIG. 6.
Figure 8:
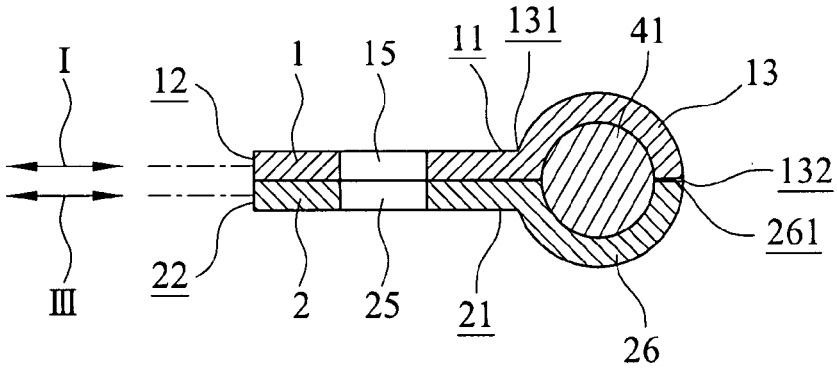
FIG. 8 is a cross sectional view taken on line 8-8 of FIG. 7.
Figure 9:
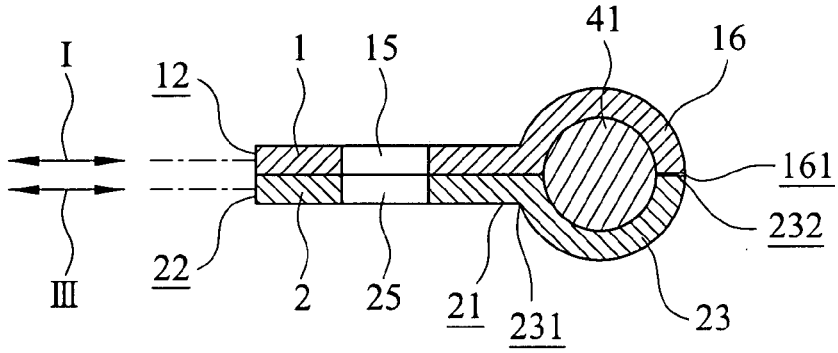
FIG. 9 is a cross sectional view taken on line 9-9 of FIG. 7.

Please refer to FIGS. 6 and 7 that are exploded and assembled perspective views, respectively, of a hinge 200 with a split barrel structure according to a second embodiment of the present invention. Since the hinge 200 is generally structurally similar to the hinge 100, elements that are the same or similar in the two hinges 100, 200 are denoted by the same reference numerals. Please also refer to FIGS. 8 and 9, which are cross sectional views taken on lines 8-8 and 9-9, respectively, of FIG. 7. The hinge 200 is different from the hinge 100 in that the free end 132 of the first partial barrel 13 in the second embodiment ends at a point adjacent to the first leaf horizontal datum plane I, and the first complementary curved part 16 is structurally identical to the first partial barrel 13. Similarly, the free end 232 of the second partial barrel 23 in the second embodiment ends at a point adjacent to the second leaf horizontal datum plane III, and the second complementary curved part 26 is structurally identical to the second partial barrel 23.

To assemble the hinge 200, first align the first leaf portion 1 with the second leaf portion 2. As a result, the first partial barrel 13 and the first complementary curved part 16 are mated with the second partial barrel 23 and the second complementary curved part 26, respectively, to form a split barrel structure with a hollow space therebetween for receiving the shaft 41 of the pintle 4 therein. Finally, the at least one binding element 3 is used to bind the first and the second leaf portion 1, 2 together, so that the shaft 41 of the pintle 4 is compressively clamped in the split barrel structure to complete the hinge 200.

Figure 10:
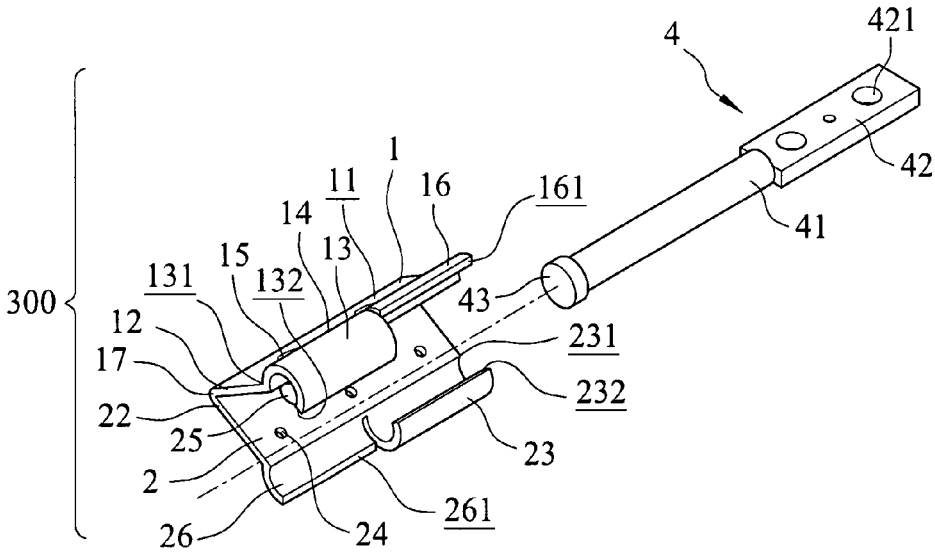
FIG. 10 is an exploded perspective view of a hinge constructed according to a third embodiment of the present invention.
Figure 11:
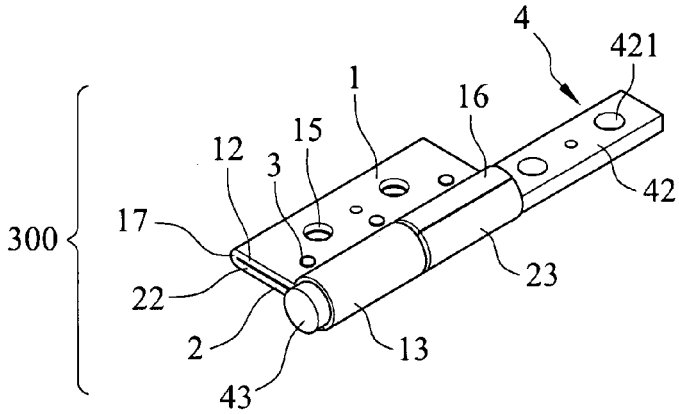
FIG. 11 is an assembled view of the hinge FIG. 10.

FIGS. 10 and 11 are exploded and assembled perspective views, respectively, of a hinge 300 having a split barrel structure according to a third embodiment of the present invention. Since the hinge 300 is generally structurally similar to the hinge 100, elements that are the same or similar in the two hinges 100, 300 are denoted by the same reference numerals. The hinge 300 is different from the hinge 100 in that the first leaf portion 1 and the second leaf portion 2 in the third embodiment are formed on one single sheet member. That is, the second edge 12 of the first leaf portion 1 is connected to the second edge 22 of the second leaf portion 2 via a bending section 17, about which the first and the second leaf portion 1, 2 may be pivotally turned relative to each other when a pressure is applied to any one of the two leaf portions 1, 2. With this arrangement, the first partial barrel 13 and the first complementary curved part 16 are mated with the second complementary curved part 26 and the second partial barrel 23, respectively, to form a split barrel structure for receiving the shaft 41 of the pintle 4 therein. Preferably, the first and the second leaf portions 1, 2 that have been aligned with and closed onto one another are firmly bound together with the at least one binding element 3, so that the shaft 41 is compressively clamped in the split barrel structure to complete the hinge 300.

Figure 12:
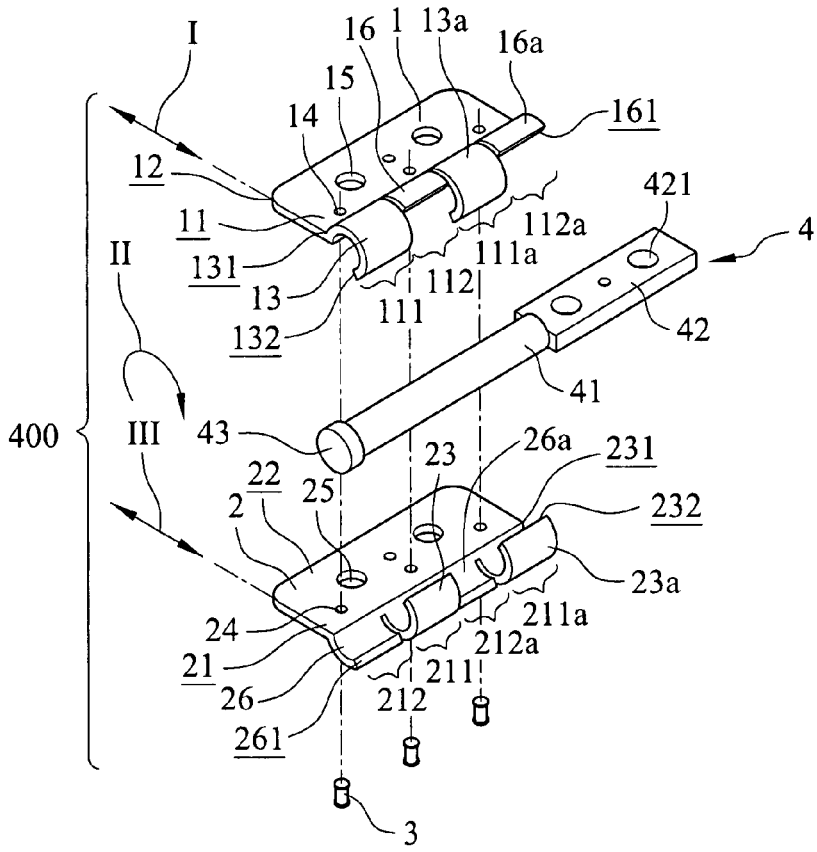
FIG. 12 is an exploded perspective view of a hinge constructed according to a fourth embodiment of the present invention.
Figure 13:
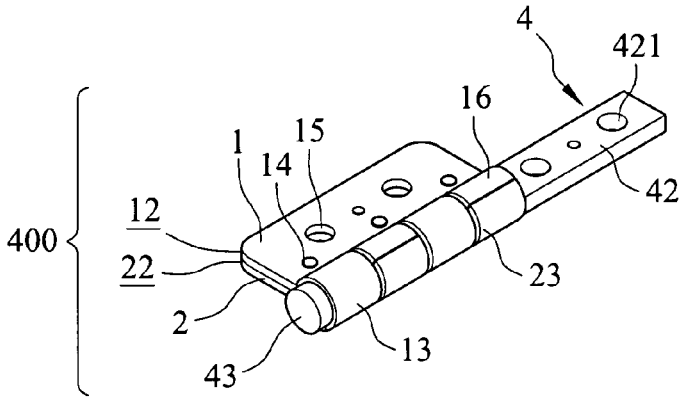
FIG. 13 is an assembled view of the hinge of FIG. 12.

FIGS. 12 and 13 are exploded and assembled perspective views, respectively, of a hinge 400 having a split barrel structure according to a fourth embodiment of the present invention. Since the hinge 400 is generally structurally similar to the hinge 100, elements that are the same or similar in the two hinges 100, 400 are denoted by the same reference numerals. The hinge 400 is different from the hinge 100 in that the first edge 11 of the first leaf portion 1 in the fourth embodiment is divided into at least two spaced barrel-forming sections 111, 111*a* and at least two spaced complement-forming sections 112, 112*a*, which are disposed in a staggered arrangement. Two first partial barrels 13, 13*a* are extended from the two barrel-forming sections 111, 111*a*, respectively; and two first complementary curved parts 16, 16*a* are extended from the two complement-forming sections 112, 112*a*, respectively.

Similarly, the second edge 21 of the second leaf portion 2 in the fourth embodiment is divided into at least two spaced barrel-forming sections 211, 211*a* and at least two spaced complement-forming sections 212, 212*a*, which are disposed in a staggered arrangement. Two second partial barrels 23, 23*a* are extended from the two barrel-forming sections 211, 211*a*, respectively; and two second complementary curved parts 26, 26*a* are extended from the two complement-forming sections 212, 212*a*, respectively.

When the first leaf portion 1 and the second leaf portion 2 in the fourth embodiment have been aligned with each other face to face, the first complementary curved parts 16, 16*a* on the first leaf portion 1 are located correspondingly to and complementarily with the second partial barrels 23, 23*a*; and the second complementary curved parts 26, 26*a* on the second leaf portion 2 are located correspondingly to and complementarily with the first partial barrels 13, 13*a*. As a result, the first partial barrels 13, 13*a* and the first complementary curved parts 16, 16*a* are mated with the second complementary curved parts 26, 26*a* and the second partial barrels 23, 23*a*, respectively, to form a split barrel structure for compressively receiving the shaft 41 of the pintle 4 therein.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A split barrel structure, which is adapted to couple a shaft of a pintle to form a hinge, the split barrel structure comprising:

a first leaf portion, being a flat sheet member extended in a first leaf horizontal datum plane, and having a first edge and a second edge opposite to the first edge; and the first edge being divided into at least a barrel-forming section and an adjoining complement-forming section;

at least one first partial barrel having a root end and a free end, the root end being connected to the at least one barrel-forming section of the first leaf portion, and the free end being extended from the root end in a first circular direction toward the barrel-forming section of the first leaf portion;

at least one first complementary curved part having a root end and a free end, the root end being connected to the complement-forming section of the first leaf portion, and the free end being extended from the root end in the first circular direction, wherein first complementary curved part adjoins the first partial barrel part, and wherein the length of the first complementary curved part in the first circular direction is less than the length of the first partial barrel part in the first circular direction;

a second leaf portion being a flat sheet member extended in a second leaf horizontal datum plane, and having a first edge and a second edge opposite to the first edge; and the first edge being divided into at least a barrel-forming section and an adjoining complement-forming section; the barrel-forming section on the second leaf portion being located corresponding to the complement-forming section on the first leaf portion, and the complement-forming section on the second leaf portion being located corresponding to the barrel-forming section on the first leaf portion;

at least one second partial barrel having a root end and a free end, the root end being connected to the at least one barrel-forming section of the second leaf portion, and the free end being extended from the root end in a second circular direction opposite to the first circular direction toward the barrel-forming section of the second leaf portion;

at least one second complementary curved part having a root end and a free end, the root end being connected to the complement-forming section of the second leaf portion, and the free end being extended from the root end in the second circular direction, wherein second complementary curved part adjoins the second partial barrel part, and wherein the length of the second complementary curved part in the second circular direction is less than the length of the second partial barrel part in the second circular direction; and at least one binding element, with which the first and the second leaf portions that have been aligned with one another face to face are bound together;

whereby when the first and the second leaf portions have been bound together by the at least one binding element, the first partial barrel and the second partial barrel clamp the shaft of the pintle therebetween, the free end of the first complementary curved part ends at a point adjacent to the free end of the second partial barrel, and the free end of the second complementary curved part ends at a point adjacent to the free end of the first partial barrel.

2. The split barrel structure as claimed in claim 1, wherein the free end of the first partial barrel extended in the first circular direction at a point located near and between the first leaf horizontal datum plane and the barrel-forming section of the first leaf portion; and wherein the free end of the second partial barrel extended in the second circular direction ends at a point located near and between the second leaf horizontal datum plane and the barrel-forming section of the second leaf portion.

3. The split barrel structure as claimed in claim 1, wherein the free end of the first partial barrel extended in the first circular direction ends at a point located near the first leaf horizontal datum plane, and the free end the first complementary curved part ends at a point located near the first leaf horizontal datum plane; and wherein the free end of the second partial barrel extended in the second circular direction ends at a point located near the second leaf horizontal datum plane, and the free end of the second complementary curved part ends at a point located near the second leaf horizontal datum plane.

4. The split barrel structure as claimed in claim 1, wherein the pintle further comprises an end plate connected to an end of the shaft and the other end of the shaft is formed with an expanded head portion, the first and the second partial barrels extended from the bound first and second leaf portions are located between an expanded head portion of the shaft and the end plate of the pintle.

5. A split barrel structure, which is adapted to couple a shaft of a pintle to form a hinge, the split barrel structure comprising:

a first leaf portion being a flat sheet member extended in a first leaf horizontal datum plane, and having a first edge and a second edge opposite to the first edge; and the first edge being divided into a barrel-forming section and an adjoining complement-forming section; a first partial barrel having a root end and a free end, the root end being connected to the barrel-forming section of the first leaf portion, and the free end being extended from the root end in a first circular direction toward the barrel-forming section of the first leaf portion;

a first complementary curved part having a root end and a free end, the root end being connected to the complement-forming section of the first leaf portion, and the free end being extended from the root end in the first circular direction, wherein first complementary curved part adjoins the first partial barrel part, and wherein the length of the first complementary curved part in the first circular direction is less than the length of the first partial barrel part in the first circular direction;

a second leaf portion being a flat sheet member extended in a second leaf horizontal datum plane, and having a first edge and a second edge opposite to the first edge; and the first edge being divided into a barrel-forming section and an adjoining complement-forming section; the barrel-forming section on the second leaf portion being located corresponding to the complement-forming section on the first leaf portion, and the complement-forming section on the second leaf portion being located corresponding to the barrel-forming section on the first leaf portion;

a second partial barrel having a root end and a free end, the root end being connected to the barrel-forming section of the second leaf portion, and the free end being extended from the root end in a second circular direction opposite to the first circular direction toward the barrel-forming section of the second leaf portion;

a second complementary curved part having a root end and a free end, the root end being connected to the complement-forming section of the second leaf portion, and the free end being extended from the root end in the second circular direction, wherein second complementary curved part adjoins the second partial barrel part, and wherein the length of the second complementary curved part in the second circular direction is less than the length of the second partial barrel part in the second circular direction; and a bending section integrally connecting the second edge of the first leaf portion to the second edge of the second leaf portion;

whereby when the bending section is bent to align the first leaf portion with the second leaf portion face to face, the first partial barrel and the second partial barrel clamp the shaft of the pintle therebetween, the free end of the first complementary curved part ends at a point adjacent to the free end of the second partial barrel, and the free end of the second complementary curved part ends at a point adjacent to the free end of the first partial barrel.

* * * * *